United States Patent [19]

Judkins et al.

[11] Patent Number: 4,580,382

[45] Date of Patent: Apr. 8, 1986

[54] CEILING PANEL ATTACHMENT MEMBER

[76] Inventors: Thomas E. Judkins, 811 Ridgeleigh Rd., Baltimore, Md. 21212; Thomas J. Stanton, 9941 Oaklea Ct., Elliott City, Md. 21043

[21] Appl. No.: 649,175

[22] Filed: Sep. 10, 1984

[51] Int. Cl.[4] ..... E04B 5/57

[52] U.S. Cl. ..... 52/489; 52/484; 52/665; 52/669

[58] Field of Search ..... 52/489, 484, 488, 664, 52/667, 730, 716, 717, 665; 403/346, 400

[56] References Cited

U.S. PATENT DOCUMENTS

| | | | |
|---|---|---|---|
| 747,253 | 12/1903 | Smith | 52/716 |
| 2,014,419 | 9/1935 | Voigt | 52/461 |
| 2,803,858 | 8/1957 | Rader | 52/489 X |
| 3,387,872 | 6/1968 | Lovullo et al. | 52/463 X |
| 3,557,513 | 1/1971 | Girard | 52/738 X |
| 3,648,051 | 2/1972 | Kolesar | 52/484 X |
| 4,027,454 | 6/1977 | Schuplin | 52/489 X |
| 4,157,000 | 6/1979 | Sutter | 52/489 |
| 4,257,205 | 3/1981 | Kuhr | 52/484 |
| 4,257,206 | 3/1981 | Mieyal | 52/726 X |
| 4,272,937 | 6/1981 | Brugman | 52/489 X |
| 4,307,553 | 12/1981 | Puckett | 52/470 |
| 4,328,653 | 5/1982 | Anderle | 52/489 X |
| 4,361,996 | 12/1982 | Smith | 52/484 |
| 4,448,006 | 5/1984 | Worley | 52/489 X |

FOREIGN PATENT DOCUMENTS

| | | | |
|---|---|---|---|
| 1327617 | 4/1963 | France | 52/489 |

*Primary Examiner*—Stuart S. Levy
*Assistant Examiner*—Joseph J. Hail, III
*Attorney, Agent, or Firm*—Larson and Taylor

[57] ABSTRACT

An improved ceiling attachment member is provided for attaching flanged ceiling panels having flanges along both lateral edges thereof to a ceiling structure to form a ceiling. The attachment member comprising an elongate support element which is secured to the ceiling structure and which provides for attachment of a plurality of such flanged ceiling panels thereto so that the ceiling panels are supported thereby and are thus suspended from the ceiling structure. A plurality of pairs of attachment lugs are partially punched out of the support element to extend outwardly at an angle therefrom are disposed at an acute angle with respect to the longitudinal axis of the support element so that the edges thereof engage the lateral flanges of a corresponding ceiling panel, and support the panel in a position wherein the panel extends traversely to the longitudinal axis of the support element and is spaced a predetermined distance from the adjacent panels and such that lugs additionally serve in guiding the ceiling panel into position during the installation thereof.

18 Claims, 9 Drawing Figures

CEILING PANEL ATTACHMENT MEMBER

FIELD OF THE INVENTION

The present invention relates to ceiling panel constructions and more particularly, to an improved attachment member for modular linear ceiling panels.

BACKGROUND OF THE INVENTION

Ceiling panel constructions or assemblies take numerous forms. Some examples of such constructions are disclosed in U.S. Pat. Nos. 4,361,996 (Smith); 4,257,205 (Kuhr); 3,557,513 (Girard); 2,014,419 (Voigt); 4,027,454 (Schuplin); 4,307,553 (Puckett) and, 3,387,872 (Lovullo et al).

In some ceiling constructions, the linear ceiling panels are supported in spaced relationship from a ceiling grid system, consisting of cross tees and main tees, i.e., tee-shaped members whose tee-forming base flange forms a support from which the ceiling panels can be supported, while in others, a more direct connection is provided to the existing plaster or plaster board ceiling. While ceiling constructions of the prior art are adequate for their intended purposes, they suffer disadvantages with respect to ease of installation, ease of manufacture of the component parts, and the like.

SUMMARY OF THE INVENTION

In accordance with the invention, an improved attachment member for linear ceiling panels is provided which affords a number of important advantages over the prior art. The attachment members can be attached to the cross tee, or the main tee, of a ceiling grid system such as described above (preferably using an integral clip) so as to provide support for the entire ceiling system, or the attachment members can be secured to an existing plaster or plasterboard ceiling. As explained in more detail below, attachment lugs are provided into the attachment members which are of such a configuration, placement and angle so as to provide a lead or guide for easy snap-in installation of the panels as well as positive secure support of the panels at well defined spacings. The lugs can be punched in during a single operation of a punch press, thus greatly simplifying the manufacturing process.

According to a preferred embodiment of the invention, a ceiling attachment member is provided for attaching flanged ceiling panels having flanges along both lateral edges thereof to a ceiling structure to form a ceiling, the attachment member comprising an elongate support element including means for enabling the support element to be secured to the ceiling structure and means for providing attachment of a plurality of the flanged ceiling panels thereto so that the ceiling panels are supported thereby and are thus suspended from the ceiling structure; The attachment means of the support element comprise a plurality of pairs of attachment lugs partially punched out of the support element to extend outwardly at an angle from the plane of the support element. The lugs are disposed at angle with respect to the longitudinal axis of the support element so that the edges thereof engage the lateral flanges of a corresponding ceiling panel and support the panel in a position wherein the panel extends traversely to the longitudinal axis of the support element and is spaced a predetermined distance from the adjacent panels. The lugs additionally serve in guiding the associated ceiling panels into position during the installation thereof.

At least one pair of lugs is provided in the support element for each panel supported the support element, and advantageously, two pairs of lugs are employed. The joining edges of each pair of lugs, i.e., the edges which join the lugs to body of the support element, are non-parallel and form equal acute angles measured from the adjacent edge of the support element. The acute angle so formed lied in a range between about 25 degrees and 45 degrees, and in specific exemplary embodiment, the acute angle is approximately 35 degrees. Preferably, the lugs are generally semicircular in shape. The lugs preferably form an acute angle with the plane of the support element and in a specific exemplary embodiment, this angle is approximately 45 degrees.

The means for enabling the support element to be secured to the ceiling structure preferably comprises integral raised clips for engaging the base flange of a tee shaped ceiling support emember. In accordance with this embodiment, a plurality of tee-shaped ceiling support members are provided each including a tee forming base flange, and a plurality of the attachment members are individually secured to the base flange of a corresponding ceiling support member. A predetermined number of flanged ceiling panels are then supported by each of the attachment members, in orthogonal relationship to that attachment member. In a specific embodiment, the ceiling panels are supported in spaced relationship and further ceiling panels are snapped into place therebetween.

Other features and advantages of the invention will be set forth in, or apparent from the detailed description of a preferred embodiment which follows.

DESCRIPTION OF THE PREFERRED EMBODIMENTS

Figure 1:
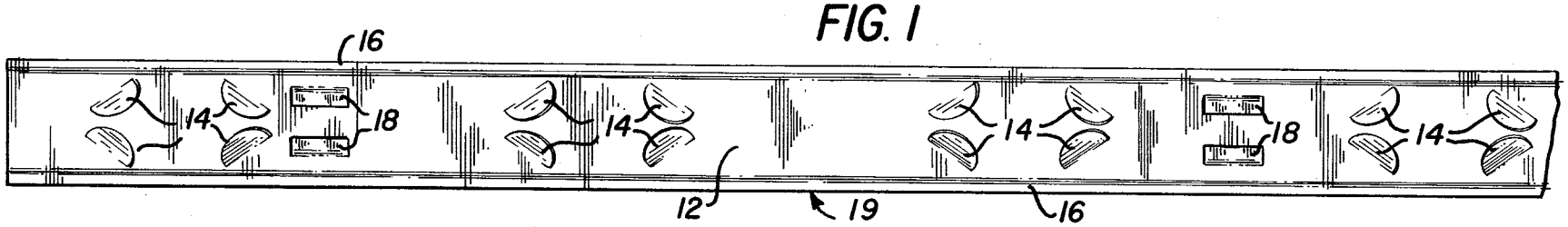
FIG. 1 is a plan view of the ceiling attachment member of the invention.
Figure 2:
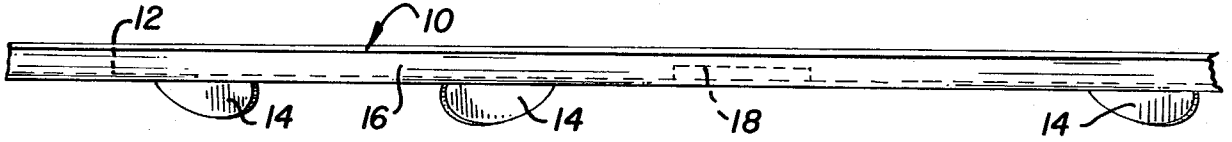
FIGS. 2, 3 and 4 are side elevational, plan and end elevational views, respectively, drawn to an enlarged scale, of the attachment member of FIG. 1.

Referring to FIGS. 1 to 5, there is shown an attachment member, generally denoted 10, which is constructed in accordance with a preferred embodiment of the invention. The attachment member comprises an elongate strip of metal 12, such as aluminum, having a series of lugs or tabs 14 partially punched out at an angle therein. The metal strip 10 includes beveled flanges 16 (best seen in FIG. 4) extending along both edges thereof and arranged at an angle of approximately 45 degrees to the plane of strip 10 in an exemplary embodiment.

Figure 4:
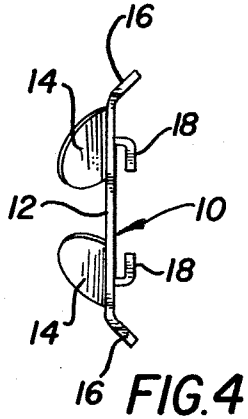

As shown in FIG. 4 the lugs 14 are arranged in groups of four, in a pattern described in more detail below, and pairs of raised connecting clips or lugs 18 are punched out at spaced intervals along strip 12 between the groups of lugs 14. Clips 18 are of a form which is best seen in FIG. 4 and serve in connecting the strip 12 to a tee member of a ceiling grid system as described hereinafter in connection with FIGS. 6 to 9.

Figure 3:
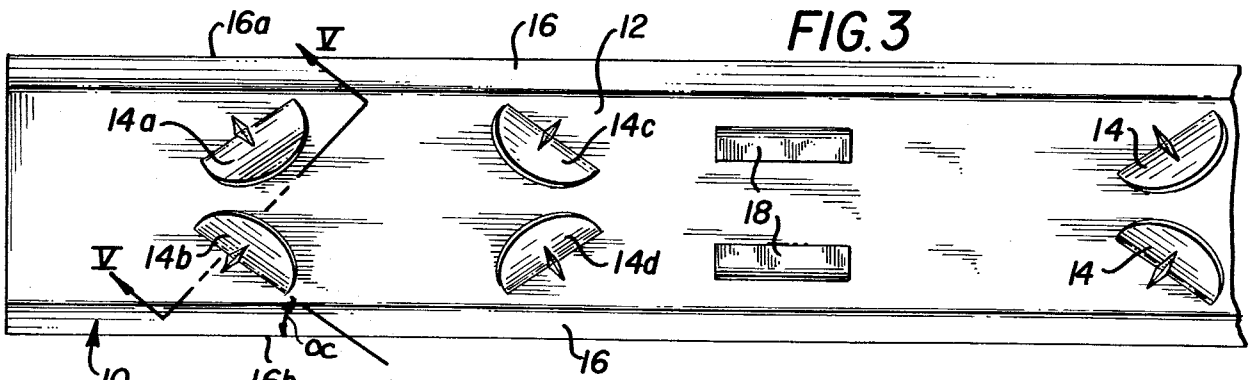
Figure 5:
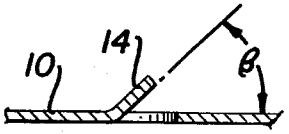
FIG. 5 is a section taken generally along line V—V in FIG. 3.

Attachment lugs 14 are shown most clearly in FIGS. 2 to 5 and, as shown, are generally semi-circular in shape. The line of joindure formed at the base of each lug 14 forms an acute angle (see FIG. 3) of with the adjacent edge of strip 12. The angle is 35 degrees in a specific embodiment and preferably lies in a range between about 25 degrees and about 45 degrees. The lugs are punched out so as to leave a gusset or indentation 14*a* which is 0.06 deep in a specific embodiment and is located approximately one-third of the length of the lower edge of the lug from the outermost point as shown in FIG. 3. This distance is 0.25 inches in a specific embodiment. As illustrated in FIG. 5, lugs 14 also form an acute angle with the plane of the strip 12. The angle is 45 degrees in a specific exemplary embodiment.

Figure 6:
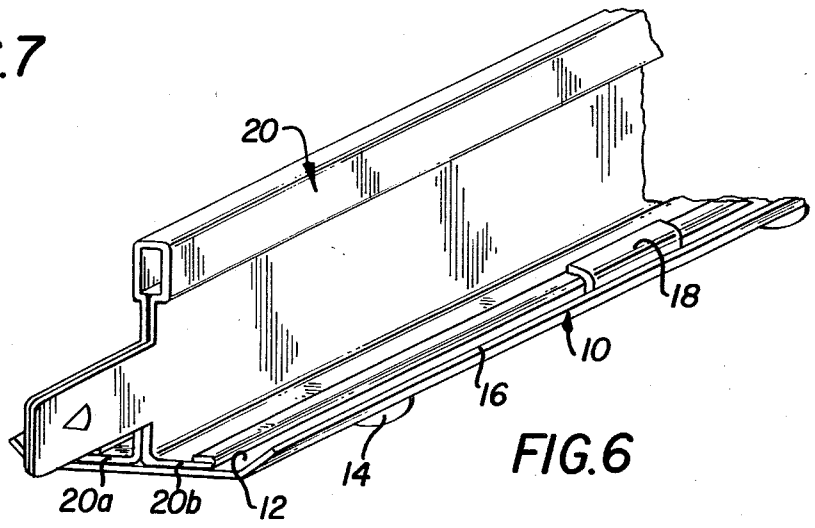
FIG. 6 is a perspective view of a tee member with the attachment member of the invention affixed thereto.

As shown in FIG. 3, the lugs 14 are grouped in groups of four with their edges forming a generally diamond shaped configuration. As stated above, the joining edges of the lugs 14 form an acute angle of 35 degrees with the adjacent edge in an exemplary preferred embodiment. More particularly, referring to the group of four lugs shown at the left hand portion of FIG. 3, and using edge 16*a* as a reference, the joining edge of lug 14*a* forms angle of 215 degrees with the right hand portion of edge 15*a* and that of lug 14*c* forms an angle of 325 degrees. Similarly, using edge 16*b* as a reference, lug 14*d* forms an angle of 35 degrees with that edge and lug 14*b* an angle of 145 degrees. As discussed above, lugs are of such a configuration, placement and angle so as to provide a lead or guide for the easy installation and precise spacing of the associated ceiling panels as discussed below. Referring to FIG. 6, a perspective view is shown of a conventional tee member 20 to which an attachment member 10 is secured. The tee member 20 may be a cross tee or a main tee and includes lateral flanges 20*a* and 20*b* to which the corresponding connecting lugs 18 of attachment member 10 are affixed so that attachment member 10 is secured to the bottom of tee member 20 as shown.

Figure 7:
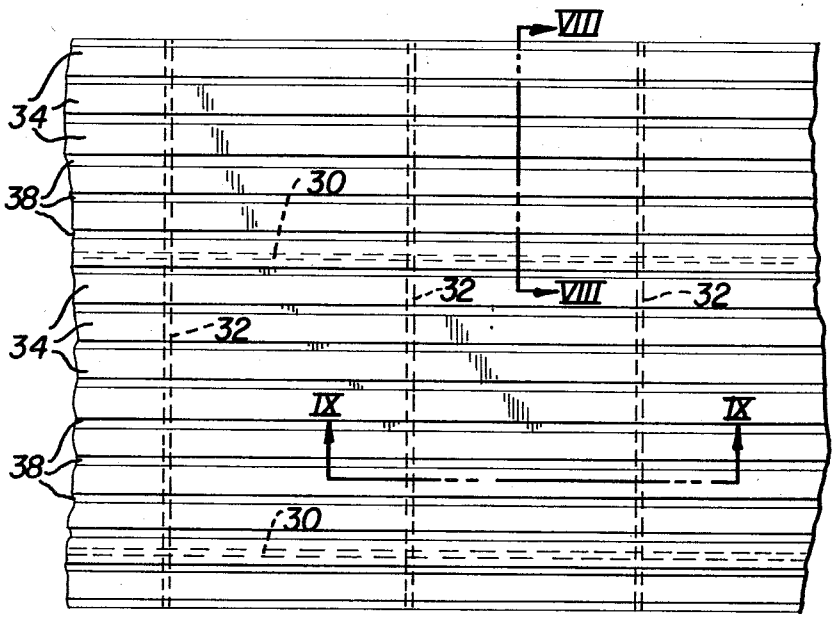
FIG. 7 is a schematic plan view of a ceiling grid construction incorporating main tee members and cross tee members.
Figure 8:
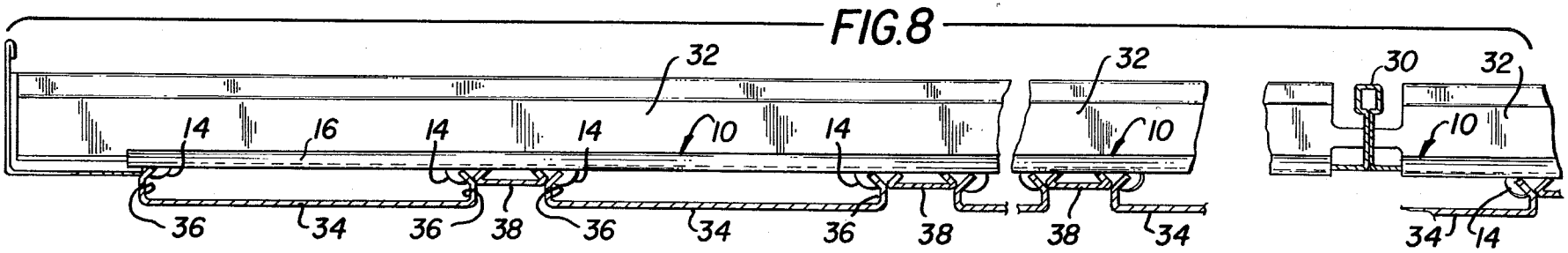
FIG. 8 is a cross sectional view taken generally along line VIII—VIII of FIG. 7.
Figure 9:
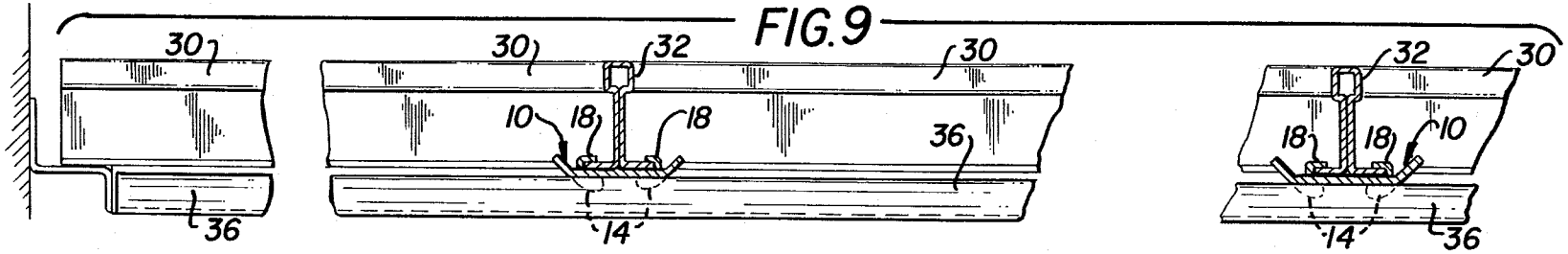
FIG. 9 is a cross sectional view taken generally along line IX—IX of FIG. 7.

Referring to FIG. 7, a grid of main tee-shaped runners and carrier cross tees 32 is provided. As shown in FIGS. 8 and 9, tee members 30 and 32 support the attachment members of invention which, in turn, support transverse ceiling panels. In a typical configuration, the main runners 30 are spaced four feet apart and the carrier cross tees 32 are also spaced four feet apart.

Referring to FIG. 8, a carrier cross tee 32 is shown to which is affixed an attachment member 10. A main runner 30 is also indicated. Attachment member 10 is secured to carrier cross tee 32 in the manner indicated in FIG. 6, i.e., by connecting clips 18, so that attachment lugs 14 extend downwardly from the bottom of strip 12. Lugs 12 are aligned so that ceiling panels 34 can be hung therefrom, the flanged or beveled edges 36 of panels 34 engaging the lateral edges of lugs or tabs 14. Lugs 14 provide some flexibility and enable the edges 36 of panels 34 to be snap fit in place while providing guidance of the movement of the panels in the installation operation.

Smaller panels 38 are snapped into place between the lateral edges of panels 34. In a typical installation panels 34 are natural aluminum in color while panels 38 are prepainted black so that a decorative stripe effect is produced, although it will, of course, be appreciated that the panels can be painted any desired color.

Although the invention has been described relative to an exemplary embodiment thereof, it will be understood by those skilled in the art that variations and modifications can be effected in this exemplary embodiment without departing from the scope and spirit of the invention.

We claim:

1. A ceiling attachment member for attaching flanged ceiling panels having flanges along both lateral edges thereof to a ceiling structure to form a ceiling, said attachment member comprising an elongate support element including means for enabling the support element to be secured to the ceiling structure and means for providing attachment of a plurality of said flanged ceiling panels thereto so that the ceiling panels are supported thereby and are thus suspended from the ceiling structure, said attachment providing means comprising a plurality of attachment lugs partially punched out of the support element to extend outwardly at an angle therefrom, said lugs being disposed at angle with respect to the longitudinal axis of the support element so that the edges thereof engage the lateral flanges of a corresponding said ceiling panel and support said panel in a position wherein in the said panel extends traversely to the longitudinal axis of the support element and is spaced a predetermined distance from the adjacent panels and such that said lugs additionally serve in guiding the said ceiling panel into said position during the installation thereof, at least one pair of lugs being provided in the support element for each panel supported by the support element, the edges of the lugs which are joined to the support element being non-parallel and said edges of each pair of lugs forming equal acute angles measured from the adjacent edge of the support element.

2. An attachment member as claimed in claim 1 wherein two pairs of lugs are provided in the support element for each panel supported thereby.

3. An attachment member as claimed in claim 2 wherein said lugs are generally semicircular in shape.

4. An attachment member as claimed in claim 1 wherein said acute angle lies in a range between about 25° and 45°.

5. An attachment member as claimed in claim 4 wherein said acute angle is approximately 35°.

6. An attachment member as claimed in claim 4 wherein said lugs are generally semicircular in shape.

7. An attachment member as claimed in claim 5 wherein said lugs form an acute angle with the plane of the support element.

8. An attachment member as claimed in claim 1 wherein said acute angle lies in a range between about 25° and 45°.

9. An attachment member as claimed in claim 8 wherein said acute angle is approximately 35°.

10. An attachment member as claimed in claim 1 wherein said lugs are generally semicircular in shape.

11. An attachment member as claimed in claim 1 wherein said lugs form an acute angle with the plane of the support element.

12. An attachment member as claimed in claim 11 wherein said lugs form an angle of approximately 45° with the plane of the support element.

13. An attachment member as claimed in claim 1 wherein said means for enabling the support element to be secured to the ceiling structure comprises raised clips for engaging the base flange of a tee shaped ceiling support member.

14. In combination, a plurality of tee-shaped ceiling support members each including a tee forming base flange, a plurality of attachment members each secured to the base flange of a corresponding ceiling support member and a plurality of elongate, flanged ceiling panels supported by each of said attachment members, in orthogonal relationship to that attachment member, said flanged ceiling panels including curved flanges along the lateral edges thereof and said attachment members each comprising an elongate, generally planar support strip including raised attachment portion which grip the base flange of the associated tee shaped ceiling support member and a plurality of pairs of attachment lugs partially punched out therefrom which engage and support said ceiling panels, said lugs extending at an angle with respect to the longitudinal axis of the support strip and projecting outwardly from the planar surface of the support strip so that the edges of the lugs engage and support the lateral flanges of the ceiling panels while additionally serving to guide the ceiling panels into position during the installation of the panels, two pairs of the said lugs being provided in the support element for each panel supported thereby, said lugs being joined to the support strip along a substantially straight joining edge and the joining edges of each pair of lugs being non-parallel and forming an acute angle measured from the adjacent edge of the support strip, said acute angle being between about 25° and about 45°, and said lugs also forming an acute angle with the planar surface of the support strip.

15. The combination claimed in claim 14 wherein said lugs are generally semicircular in shape, wherein the joining edges thereof form an angle of approximately 35° with the corresponding adjacent edge of the support strip, and wherein the lugs form an angle of approximately 45° with the planar surface of the support element.

16. The combination as claimed in claim 14 wherein said ceiling panels are supported in spaced relationship and further ceiling panels are snapped into place therebetween.

17. The combination as claimed in claim 14 wherein the two pairs of lugs adjacent one edge of the support strip form angles of 35° and 145° as viewed in plan and measured in a counterwise direction from that edge and wherein the lugs adjacent the other edge of the support strip form angles of 35° and 145° as viewed in plan and measured in a clockwise direction from said other edge.

18. A combination as claimed in claim 17 wherein the lugs form an angle of approximately 45° with the planar surface of the support element.

* * * * *